US005346300A

United States Patent [19]

Yamamoto et al.

[11] Patent Number: 5,346,300

[45] Date of Patent: Sep. 13, 1994

[54] BACK FIRE HELICAL ANTENNA

[75] Inventors: Hirohiko Yamamoto; Keijirou Higashi; Hiroyuki Takebe; Hiroshi Nakano; Tomozo Ohta, all of Nara, Japan

[73] Assignee: Sharp Kabushiki Kaisha, Osaka, Japan

[21] Appl. No.: 907,137

[22] Filed: Jul. 1, 1992

[30] Foreign Application Priority Data

| | | | |
|---|---|---|---|
| Jul. 5, 1991 | [JP] | Japan | 3-165976 |
| Jul. 11, 1991 | [JP] | Japan | 3-171077 |
| Dec. 16, 1991 | [JP] | Japan | 3-331886 |

[51] Int. Cl.[5] ..... H01Q 11/08; H01Q 1/36

[52] U.S. Cl. ..... 343/895; 343/860

[58] Field of Search ..... 343/895, 700 MS File, 343/860, 863, 862, 865, 853, 859; 29/600, 601, 605, 606; H01Q 11/08, 1/36

[56] References Cited

U.S. PATENT DOCUMENTS

| | | | |
|---|---|---|---|
| 2,945,227 | 7/1960 | Broussaud | 343/731 |
| 3,419,875 | 12/1968 | Aasted | 343/895 |
| 4,008,479 | 2/1977 | Smith | 343/895 |
| 4,114,164 | 9/1978 | Greiser | 343/895 |
| 4,658,262 | 4/1987 | DuHamel | 343/895 |
| 5,170,176 | 12/1992 | Yasunaga et al. | 343/895 |

FOREIGN PATENT DOCUMENTS

| | | |
|---|---|---|
| 0320404 | 6/1989 | European Pat. Off. . |
| 0469741 | 2/1992 | European Pat. Off. . |
| 63-26004 | 2/1988 | Japan . |
| 63-30006 | 2/1988 | Japan . |
| 2-127804 | 5/1990 | Japan . |

OTHER PUBLICATIONS

Patent Abstracts Of Japan, vol. 012, No. 234 (E-629) Jul. 5, 1988 & JP-A-63 026004 (Sony Corp.) Feb. 3, 1988.

*Primary Examiner*—Donald Hajec
*Assistant Examiner*—Hoanganh Le
*Attorney, Agent, or Firm*—Nixon & Vanderhye

[57] ABSTRACT

A first radiation member 165 includes radiation conductors 166 and 167, an arm 168 and a lower connection piece 169 all integrally formed by blanking. A stub 170 is likewise integrally formed on radiation conductor 166. A second radiation member 171 includes radiation conductors 172 and 173, an arm 174 and a lower connection piece 175 all integrally formed by blanking. A stub 176 is likewise integrally formed on radiation conductor 173. A first loop comprised of radiation conductors 167 and 172, arms 168 and 174 and lower connection pieces 169 and 175 exhibits capacitive impedance at a wavelength for use. The overall length of a second loop comprised of radiation conductors 166 and 173, arms 168 and 174 and lower connection pieces 169 and 175 is set equal to that of the first loop. The second loop, however, exhibits inductive impedance at the wavelength for use by adjustment of the length of stubs 170 and 176. Adjusting stubs 170 and 176 enable control of a phase of a current flowing through the second loop.

24 Claims, 10 Drawing Sheets

BACK FIRE HELICAL ANTENNA

BACKGROUND OF THE INVENTION

1. Field of the Invention

The present invention relates to back fire helical antennas for use in a navigation system such as GPS.

2. Description of the Background Art

With recent development of an information society, a mobil radio communication and a satellite communication have been flourished, and a navigation system such as GPS for receiving radio waves of artificial satellites and detecting the position and speed of mobile bodies is put into practice. In GPS, a radio wave with a frequency of an L band is used, and a back fire helical antenna, spiral antenna and the like are used in practice as a receiving antenna.

FIG. 11 is a perspective view of a conventional back fire helical antenna. A flexible substrate film 3 is lapped around outer peripheries of a cylindrical bobbin 1 being a dielectric. Bobbin 1 serves to retain flexible substrate film 3 in a cylindrical form. Four helical radiation conductors 5, 7, 9 and 11 are formed on a surface of flexible substrate film 3 by etching.

A coaxial cable 38 is disposed at the position of a central axis of cylindrical bobbin 1. Coaxial cable 38 includes a coaxial central conductor 39, an insulator 41 provided around coaxial central conductor 39, and a coaxial outer conductor 43 provided around insulator 41.

An arm 13 is soldered by solder 45 to a first end of coaxial central conductor 39. A first end 23 of radiation conductor 5 is soldered by solder 19 onto a first end 15 of arm 13. A first end 25 of radiation conductor 7 is soldered by solder (not shown) onto a second end 17 of arm 13.

An arm 27 is soldered by solder 47 to a first end of coaxial outer conductor 43. A first end 35 of radiation conductor 9 is soldered by solder 33 to a first end 29 of arm 27. A first end 37 of radiation conductor 11 is soldered by solder (not shown) onto a second end 31 of arm 27.

A lower connection piece 49 is soldered to coaxial outer conductor 43 by solder. Respective second ends 59, 61, 63 and 65 of respective radiation conductors 11, 7, 5 and 9 are soldered, respectively, to first, second, third, and fourth connecting portions 51, 53, 55 and 57 of lower connection piece 49. Reference numerals 67 and 69 denote solders. Radiation conductors 5, 7, 9 and 11 are formed to wrap around bobbin 1.

A helical antenna operation shown in FIG. 11 will now be described. An overall length of a first loop comprised of radiation conductors 5 and 11, arms 13 and 27 and lower connection piece 49 is set to be slightly longer than a wavelength for use, and an overall length of a second loop comprised of radiation conductors 7 and 9, arms 13 and 27 and lower connection piece 49 is set to be slightly shorter than a wavelength for use. At the wavelength for use, the first longer loop exhibits inductive impedance, while the second shorter loop exhibits capacitive impedance.

Thus, provision of a suitable difference in the overall lengths of both loops results in a mutual phase difference of 90° between respective currents flowing through mutually adjacent radiation conductors 5, 7, 9 and 11 despite the fact that both loops are fed with power in parallel, so that a circularly polarized wave is efficiently radiated.

FIG. 12 is a sectional view of coaxial central conductor 39, and FIG. 13 is a sectional view of insulator 41. Coaxial central conductor 39 has such a structure that the conductor has a different diameter only by the length of $\lambda_g/4$ from a feeder 75 which is a connection portion with arm 13.

This part is called a coaxial central conductor 39*a*. Coaxial central conductor 39*a*, insulator 41 and coaxial outer conductor 43 constitute a impedance transformer. The impedance transformer serves to take a match between impedance of coaxial cable 38 and impedances of radiation conductors 5, 7, 9 and 11. $\lambda_g$ is a wavelength of a radio wave for use. While the diameter of coaxial cable 38 is made larger by the length of $\lambda_g/4$ in this example, this value varies depending on the impedance of coaxial cable 38 and the impedances of radiation conductors 5, 7, 9 and 11.

As shown in FIG. 13, a cavity 73 of insulator 41 is processed so that coaxial central conductor 39*a* fits in the cavity.

However, it is difficult to process coaxial central conductor 39 and cavity 73 in the forms shown in FIGS. 12 and 13, leading to a poor productivity of the back fire helical antenna.

In addition, in a conventional quadrifilar back fire helical antenna, since radiation conductors 5, 7, 9 and 11, arms 13 and 27 and lower connection piece 49 are separate parts, the number of places for soldering increases at the time of assembly, and also the number of working steps increases.

As a method for providing a difference in overall lengths of loops, a method for changing a pitch angle of the loops is known as disclosed in Japanese Patent Laying-Open No. 63-26004. A technique in which a parasitic object is disposed in the vicinity of a driver element and phases of currents flowing through radiation conductors 5, 7, 9 and 11 can be changed is disclosed in Japanese Patent Laying-Open No. 2-127804.

In such conventional techniques, however, a structure for realizing a desired loop length is complicated. Further, a structure for controlling phase of a current is complicated. In some case, it is difficult to assemble an antenna and also to control phase of a current flowing through a radiation conductor after completion of the assembly of the antenna.

SUMMARY OF THE INVENTION

One object of the present invention is to provide a back fire helical antenna of which productivity can be increased.

Another object of the present invention is to provide a method of manufacturing a back fire helical antenna of which productivity can be increased.

A further object of the present invention is to provide a back fire helical antenna with a simple structure in which phase of a current flowing through a radiation conductor can be controlled and even after the antenna is completed, the phase of the current can be easily controlled.

According to a first aspect of the present invention, a back fire helical antenna includes a strip line including a dielectric substrate having a main surface and a back surface, a first strip conductor formed on the main surface, a second strip conductor formed on the main surface and electrically connected with the first strip conductor, and a conductive earth plate formed on the back surface. The second strip conductor, the dielectric substrate and the conductive earth plate constitute transformation means for taking a match between impedance of a radiation conductor and that of the strip line. The radiation conductor is disposed helically about the strip line set as a center. A first end of the radiation conductor is electrically connected with the transformation means. A second end of the radiation conductor is electrically connected with the conductive earth plate.

According to a second aspect of the present invention, a back fire helical antenna includes a strip line including a dielectric substrate having a main surface and a back surface, a strip conductor formed on the main surface and having its width becoming smaller from a first end to a second end of the dielectric substrate, and a conductive earth plate formed on the back surface and having its width becoming smaller from the first end to the second end of the dielectric substrate. With the respective widths of the strip conductor and the conductive earth plate decreasing from the first end to the second end of the dielectric substrate, the strip line has a function of balun. A radiation conductor is disposed helically about the strip line being set as a center. The radiation conductor has a first end electrically connected with a balun and a second end electrically connected with the conductive earth plate.

According to a third aspect of the present invention, a back fire helical antenna includes a radiation member comprised of a first radiation conductor, a second radiation conductor disposed in parallel and spaced apart from the first radiation conductor, a first end connecting member for electrically connecting a first end of the first radiation conductor and a first end of the second radiation conductor, and a second end connecting member for electrically connecting a second end of the first radiation conductor and a second end of the second radiation conductor, all being integrally formed together. The radiation member is provided such that the first and second radiation conductors are of a helical form about a feeder set as a center. The first and second end connecting members are electrically connected to the feeder.

According to a fourth aspect of the present invention, a back fire helical antenna is characterized in that a first stub for controlling phase of a current flowing through a first radiation conductor is provided in the first radiation conductor.

According to a fifth aspect of the present invention, a method of manufacturing a back fire helical antenna includes the steps of: forming a radiation member of the third aspect by blanking out a conductive plate member; bending the radiation member in a helical form; disposing the helical radiation member so that first and second radiation conductors are formed helically about a feeder being set as a center; and electrically connecting first and second end connecting members to the feeder.

According to the first aspect of the present invention, the strip line is employed in place of a coaxial cable. Since the first and second strip conductors formed on the main surface of the dielectric substrate can be formed by etching, formation of the transformation means is facilitated.

According to the second aspect of the present invention, the back fire helical antenna has the strip conductor and the conductive earth plate with their width decreasing from the first end to the second end of the dielectric substrate. This results in such an effect that there is no need to provide a new balun in addition to the effects of the first aspect.

According to the third aspect of the present invention, the radiation member incorporated has such a structure that the first and second radiation conductors and the first and second end connecting members are formed integrally. Thus, only two connecting places in assembly are required, that is, one between the first end connecting member and the feeder, and the other between the second end connecting member and the feeder. In other words, since conventionally separate parts are united together, the number of parts and the number of connecting places in assembly can be decreased.

According to the fourth aspect of the present invention, the first stub is provided in the first radiation conductor. Since the phase of a current flowing through the first radiation conductor can be controlled depending on the length, the width and the like of the first stub, the phase of the current can easily be controlled even after the antenna is completed. Further, since the first stub is united with the first radiation conductor, the assembly of the antenna does not become difficult.

According to the fifth aspect of the present invention, since the antenna is formed by employing the radiation member of the third aspect, the number of connecting places decreases and productivity of the antenna increases.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

A First Embodiment

Figure 1:
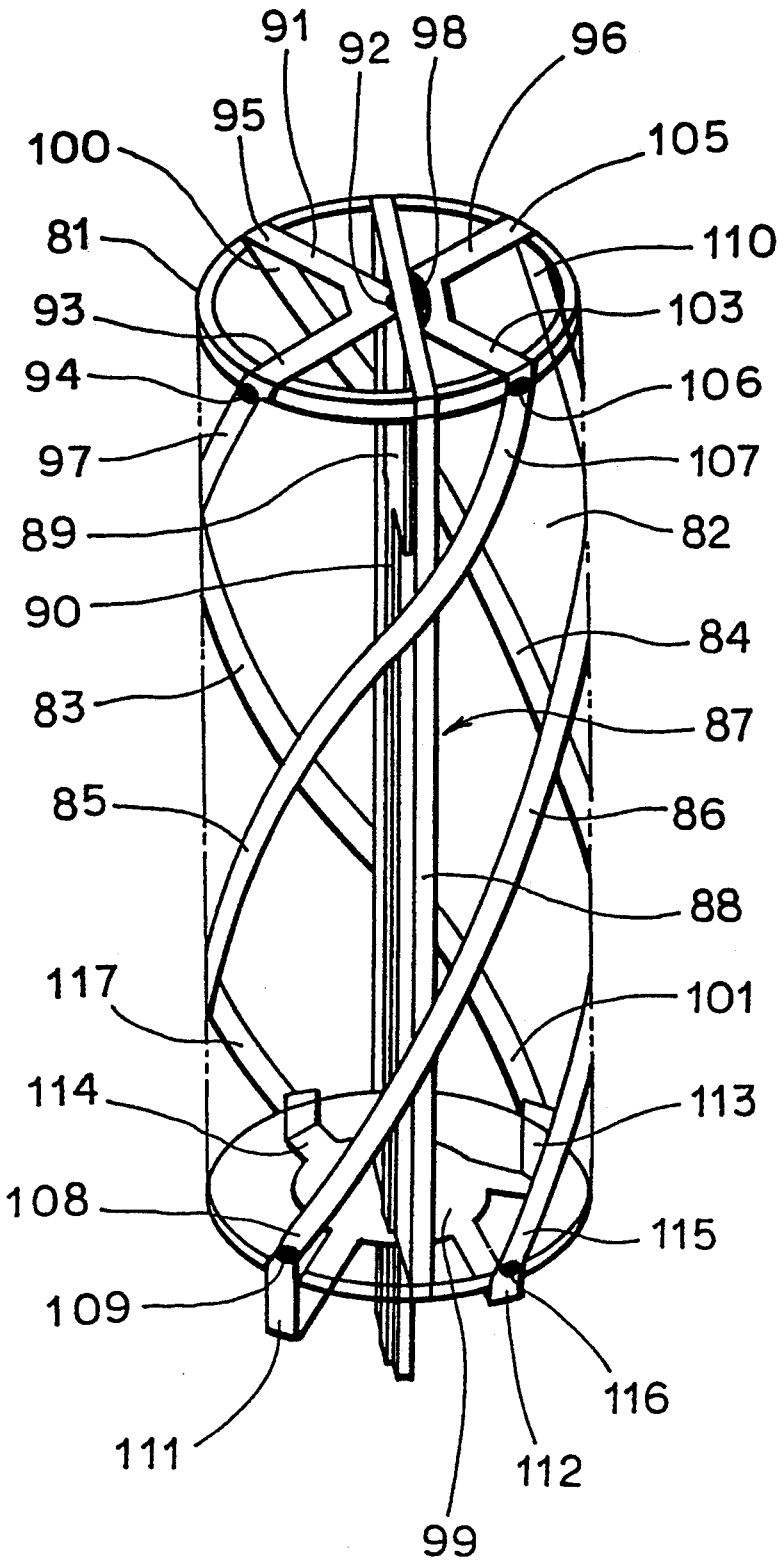
FIG. 1 is a perspective view of a first embodiment of a back fire helical antenna according to the present invention.

FIG. 1 is a perspective view of a first embodiment of a back fire helical antenna according to the present invention. A flexible substrate film 82 is lapped around an outer circumference of a cylindrical bobbin 81 being a dielectric. Bobbin 81 serves to maintain flexible substrate film 82 in a cylindrical form. Four helical radiation conductors 83, 84, 85 and 86 are formed by etching on a surface of flexible substrate film 82. A microstrip line 87 is provided inside bobbin 81. Microstrip line 87 is comprised of a dielectric substrate 88 made of glass epoxy or the like, first and second strip conductors 90 and 89 made of copper foils and formed on a main surface of dielectric substrate 88, and an earth plate (not shown in FIG. 1) made of copper foils and formed on a back surface of dielectric substrate 88. Second strip conductor 89, dielectric substrate 88 and the earth plate constitute a impedance transformer for taking matches between impedances of radiation conductors 83, 84, 85 and 86 and that of microstrip line 87.

An arm 91 is soldered on second strip conductor 89 by soldering. A first end 97 of radiation conductor 83 is soldered by solder 94 to a first end 93 of arm 91. A first end 100 of radiation conductor 84 is soldered by solder (not shown) to a second end 95 of arm 91.

An arm 96 is soldered by solder 98 on the earth plate (not shown in FIG. 1). A first end 107 of radiation conductor 85 is soldered by solder 106 to a first end 103 of arm 96. A first end 110 of radiation conductor 86 is soldered by solder (not shown) to a second end 105 of arm 96.

A lower connection piece 99 is soldered by solder on the earth plate. Respective second ends 108, 115, 101 and 117 of respective radiation conductors 86, 84, 83 and 85 are soldered, respectively, on first, second, third and fourth connecting portions 111, 112, 113 and 114 of lower connection piece 99. Reference numerals 109 and 116 denote solders. Radiation conductors 83, 84, 85 and 86 are lapped around bobbin 81.

Figure 2:
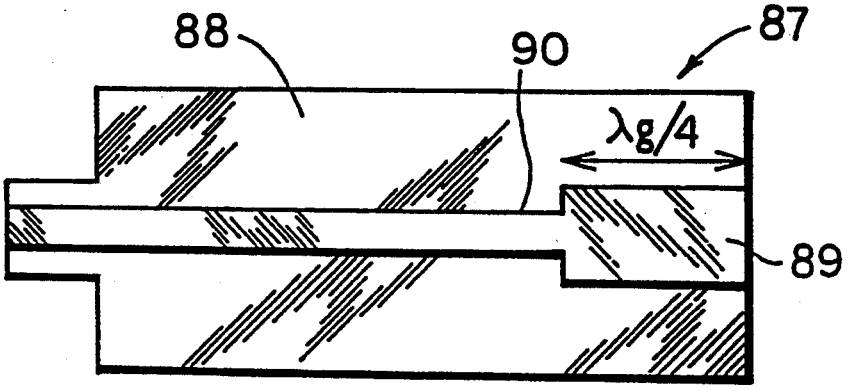
FIG. 2 is a plan view of a microstrip line incorporated in the first embodiment.

FIG. 2 is a plan view of microstrip line 87. First strip conductor 90 and second strip conductor 89 are formed by etching the copper foils formed on the main surface of dielectric substrate 88. Second strip conductor 89 has a length of $\lambda_g/4$, however, its length is varied with the impedances of the radiation conductors and that of the microstrip line.

Figure 3:
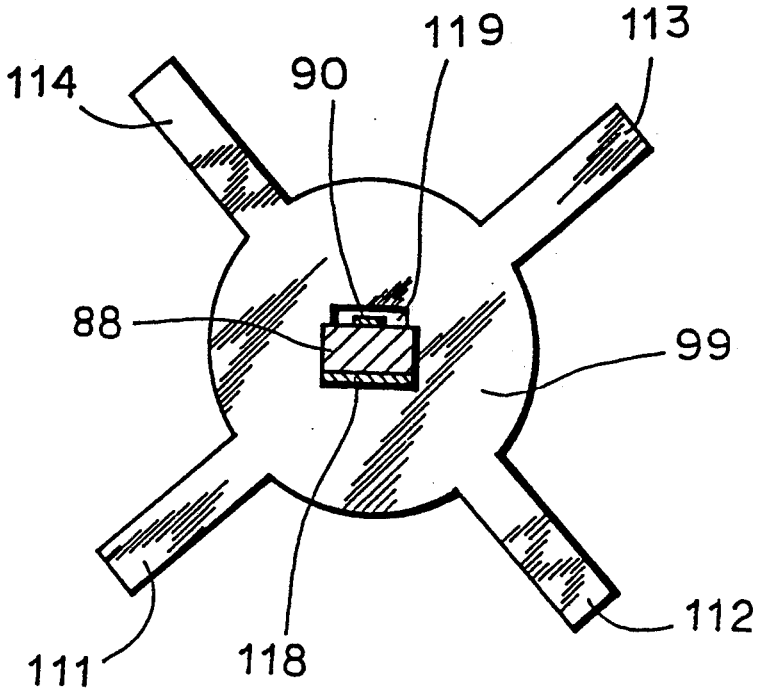
FIG. 3 is a plan view of a lower connection piece incorporated in the first embodiment.

FIG. 3 is a plan view of lower connection piece 99. An earth plate 118 formed on the back surface of dielectric substrate 88 is connected with lower connection piece 99, whereas first strip conductor 90 and lower connection piece 99 are not connected with each other because of space 119 therebetween.

A Second Embodiment

Figure 4:
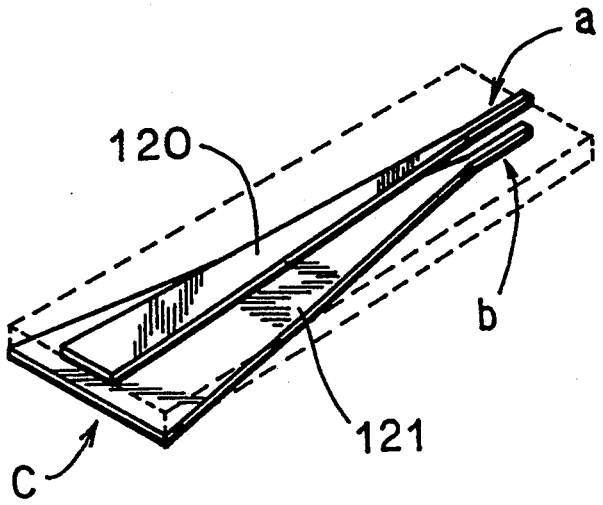
FIG. 4 is a perspective view of a microstrip line incorporated in a second embodiment of a back fire helical antenna according to the present invention.

FIG. 4 is a perspective view of a microstrip line incorporated in a second embodiment of a back fire helical antenna according to the present invention. On this microstrip line, a balun is formed in place of a impedance transformer. A strip conductor and an earth plate are denoted with reference numerals 120 and 121, respectively. The balun is constituted by gradually decreasing respective widths of strip conductor 120 and earth plate 121. In this embodiment, since the balun is incorporated, no impedance transformer is required. While this microstrip line uses air as a dielectric, a dielectric substrate 186 may be provided between strip conductor 120 and earth plate 121.

The second embodiment is identical to the first embodiment except the structure of the microstrip line. In the second embodiment, arm 91 (see FIG. 1) is connected to a portion denoted with a of strip conductor 120; arm 96 (see FIG. 1) is connected to a portion denoted with b of earth plate 121; and lower connection piece 99 (see FIG. 1) is connected to a portion denoted with c of earth plate 121. Since this balun can be formed by etching, the balun can easily be formed.

A Third Embodiment

Figure 5:
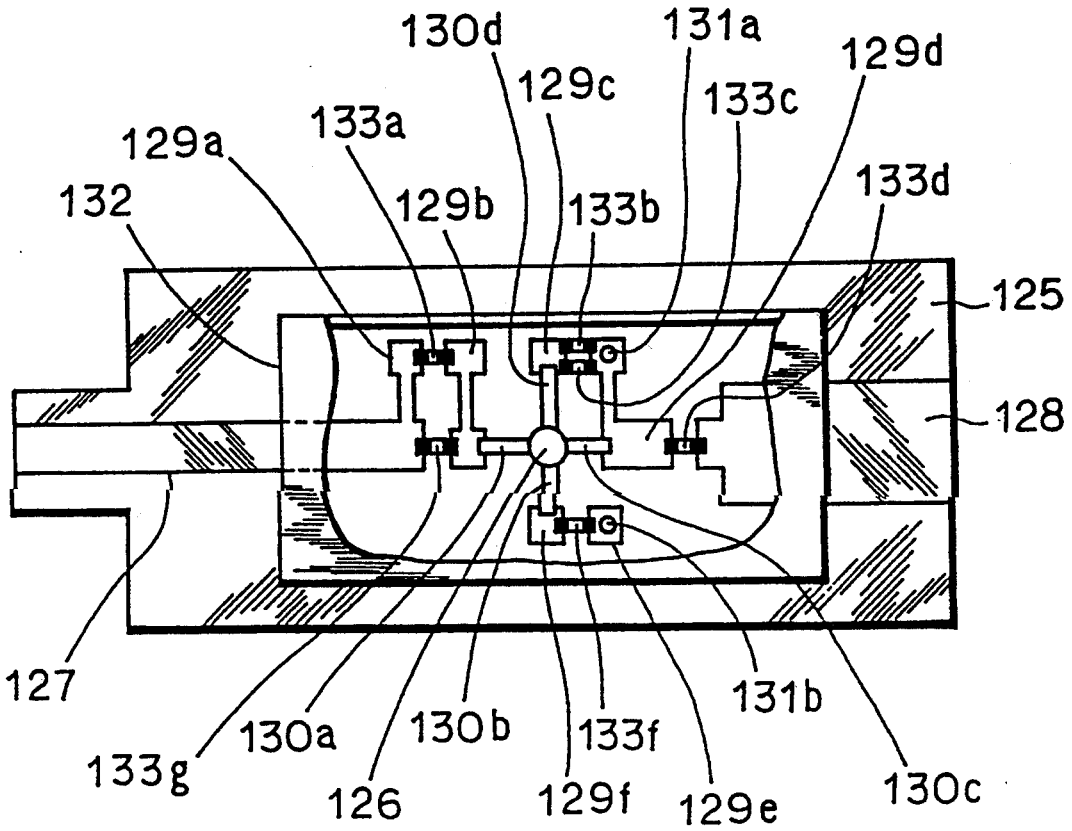
FIG. 5 is a plan view of a microstrip line incorporated in a third embodiment of a back fire helical antenna according to the present invention.

FIG. 5 is a plan view of a dielectric substrate incorporated in a third embodiment of a back fire helical antenna according to the present invention. On a dielectric substrate 125 is formed a low noise amplifier circuit which is an amplifier circuit formed of a field effect transistor 126 or the like and causing less noise.

A first strip conductor 127, a second strip conductor 128 and wiring patterns **129*a*–129*f* are formed on dielectric substrate 125. Those elements are formed at the same time by etching. A field effect transistor 126 is formed in a part of dielectric substrate 125 which is between first and second strip conductors 127 and 128. Field effect transistor 126 has its gate connected with wiring pattern 129*d* by a lead 130*c*, its drain connected with wiring pattern 129*b* by a lead 130*a* and its source connected with wiring patterns 129*f* and 129*c* by leads 130*b* and 130*d***, respectively.

Wiring patterns **129*a* and 129*b* are connected with each other by chip parts 133*a* and 133*g*; wiring patterns 129*c* and 129*d* by chip parts 133*b* and 133*c*; wiring pattern 129*d* and second strip conductor 128 by chip parts 133*d*; and wiring patterns 129*f* and 129*e* by chip parts 133*f*. The chip parts are resistors, capacitors and the like in the form of chips. Wiring patterns 129*d* and 129*e* are connected via, respectively, through holes 131*a* and 131*b* to an earth plate of the back surface of dielectric substrate 125. The low noise amplifier circuit is covered with a shielding case 132. A part of shielding case 132** is notched to facilitate understanding of the structure of the low noise amplifier circuit; however, there is actually no such notch.

A signal transmitted from second strip conductor 128 is amplified by the low noise amplifier circuit and then transmitted to first strip conductor 127. In the third embodiment, the low noise amplifier circuit is formed on dielectric substrate 125, thereby enabling a smaller scale of antennas. Power amplification circuit may be employed not only in reception but also in transmission.

A Fourth Embodiment

Figure 6:
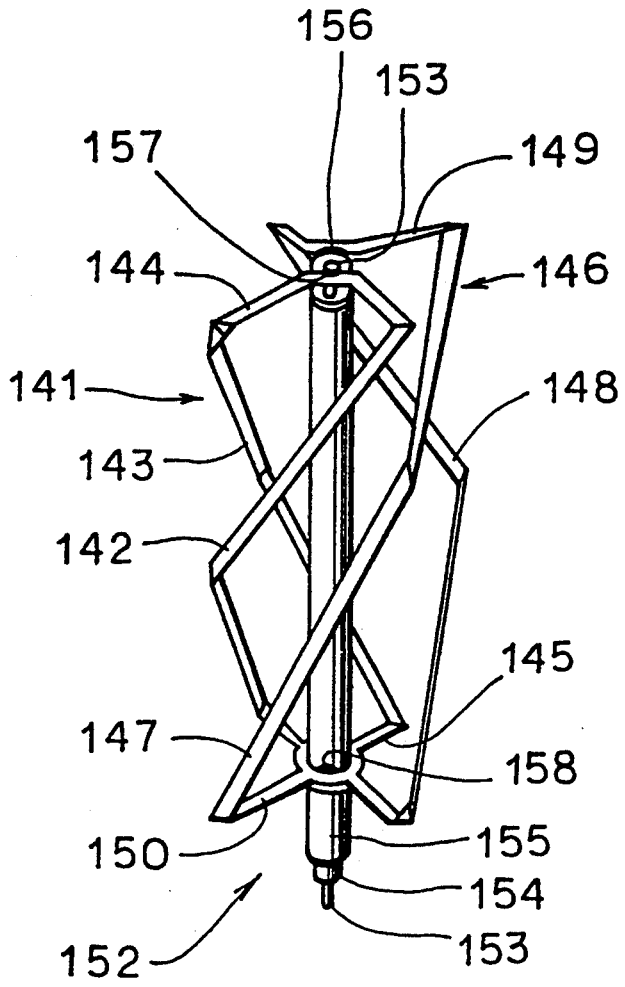
FIG. 6 is a perspective view of a fourth embodiment of a back fire helical antenna according to the present invention.

FIG. 6 is a perspective view of a fourth embodiment of a back fire helical antenna according to the present invention. A first radiation member 141 is of such a structure that radiation conductors 142 and 143, an arm 144 and a lower connection piece 145 are formed integrally. A second radiation member 146 is of such a structure that radiation conductors 147 and 148, an arm 149 and a lower connection piece 150 are formed integrally. First and second radiation members 141 and 146 are conductor plates which are approximately 0.5 to 2 mm in thickness and have appropriate rigidity such as cold rolled iron plates, aluminum plates and brass plates. A reference numeral 152 denotes a coaxial cable. Coaxial cable 152 includes a coaxial central conductor 153, an insulator 154 and a coaxial outer conductor 155.

Figure 7:
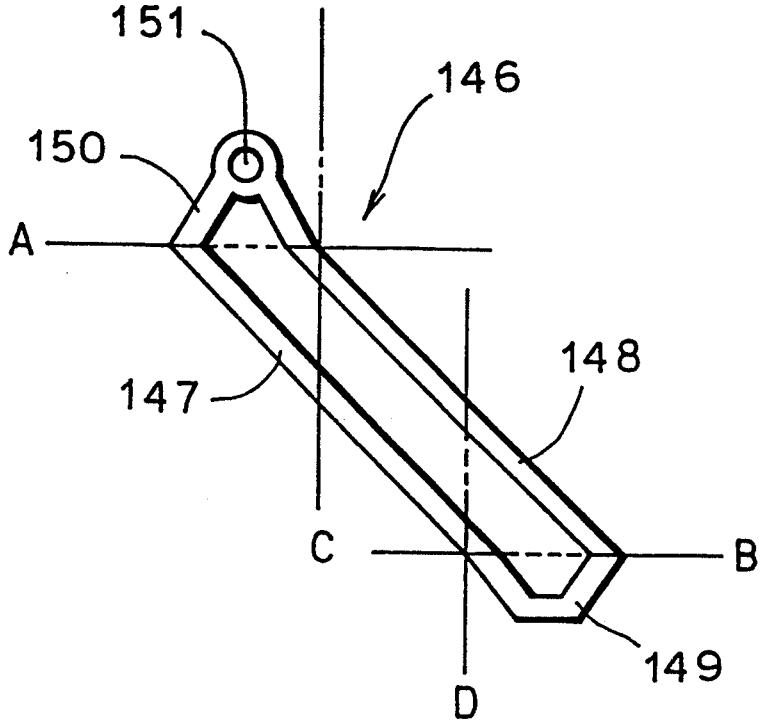
FIG. 7 is a plan view of a radiation member incorporated in the fourth embodiment.

Second radiation member 146 is formed in the shape shown in FIG. 7 by blanking of thin plate press. By bending portions shown by two-chain dotted lines of A–D by about 90°, each part of radiation conductors 147 and 148, arm 149 and lower connection piece 150 is formed. Two arms of arm 149 have different lengths. Portions A–D need not necessarily be bent orthogonally, and they may be bent such that their corners are rounded. A reference numeral 151 denotes a through hole. Coaxial cable 152 is inserted into through hole 151. First radiation member 141 is formed in the same manner as second radiation member 146.

Figure 8:
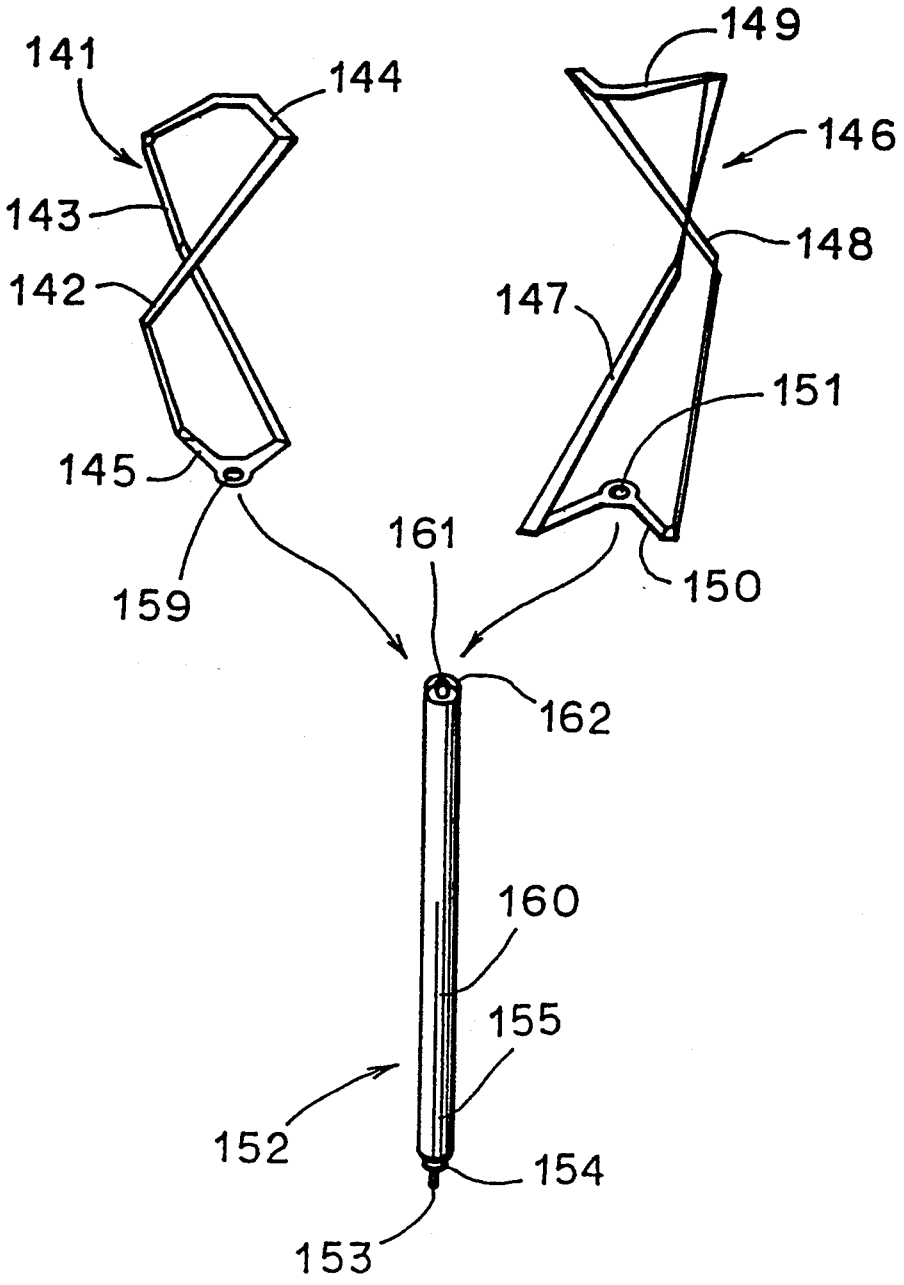
FIG. 8 is a perspective view for use in explaining assembly of the fourth embodiment.

With the bent first and second radiation members 141 and 146 facing each other as shown in FIG. 8, through holes 151 and 159 are inserted into coaxial cable 152. Through holes 151 and 159 are soldered to a solder portion 160 of coaxial outer conductor 155; arm 144 is soldered to a solder portion 161 of coaxial central conductor 153; and arm 149 is soldered to a solder portion 162 of coaxial outer conductor 155. This state is shown in FIG. 6. Reference numerals 156, 157 and 158 denote solders.

Figure 9:
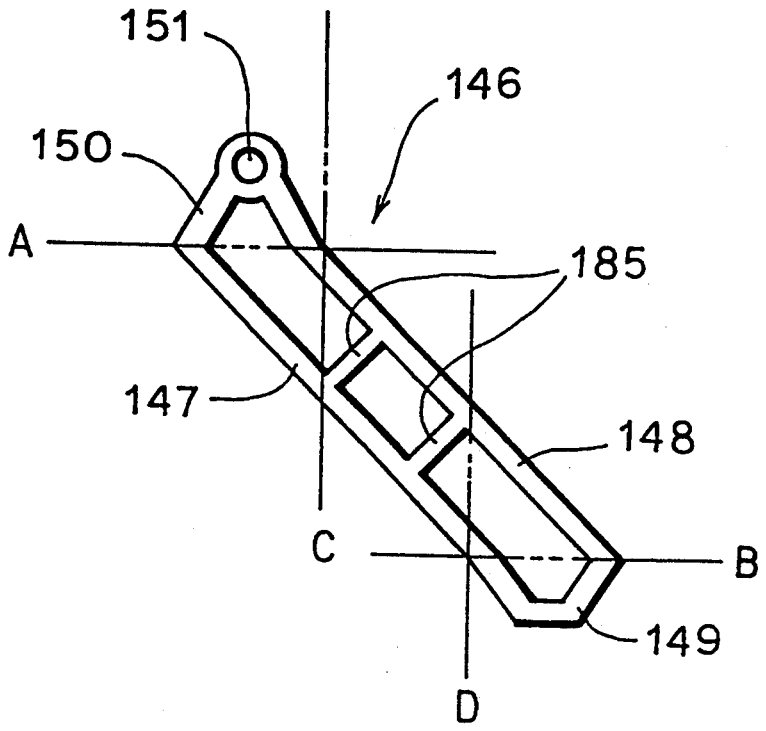
FIG. 9 is a plan view of another example of the radiation member incorporated in the fourth embodiment.

As first and second radiation members 141 and 146, those shown in FIG. 9 may be used. Radiation conductors 147 and 148 are connected with each other by a rib 185. This rib 185 is formed at the time of blanking. After bending of portions A–D, rib 185 is cut out and removed. Provision of rib 185 enables a reduction in variation of shapes of radiation conductors 147 and 148 such as warp and burr at the time of bending. This makes it possible to decrease variations in the form of radiation conductors 147 and 148 after the assembly of the antenna is completed.

While the quadrifilar back fire helical antenna has been described in this embodiment, a bifilar antenna employs only first radiation member 141. A multi-filar back fire helical antenna may employ an additional radiation member.

A Fifth Embodiment

Figure 10:
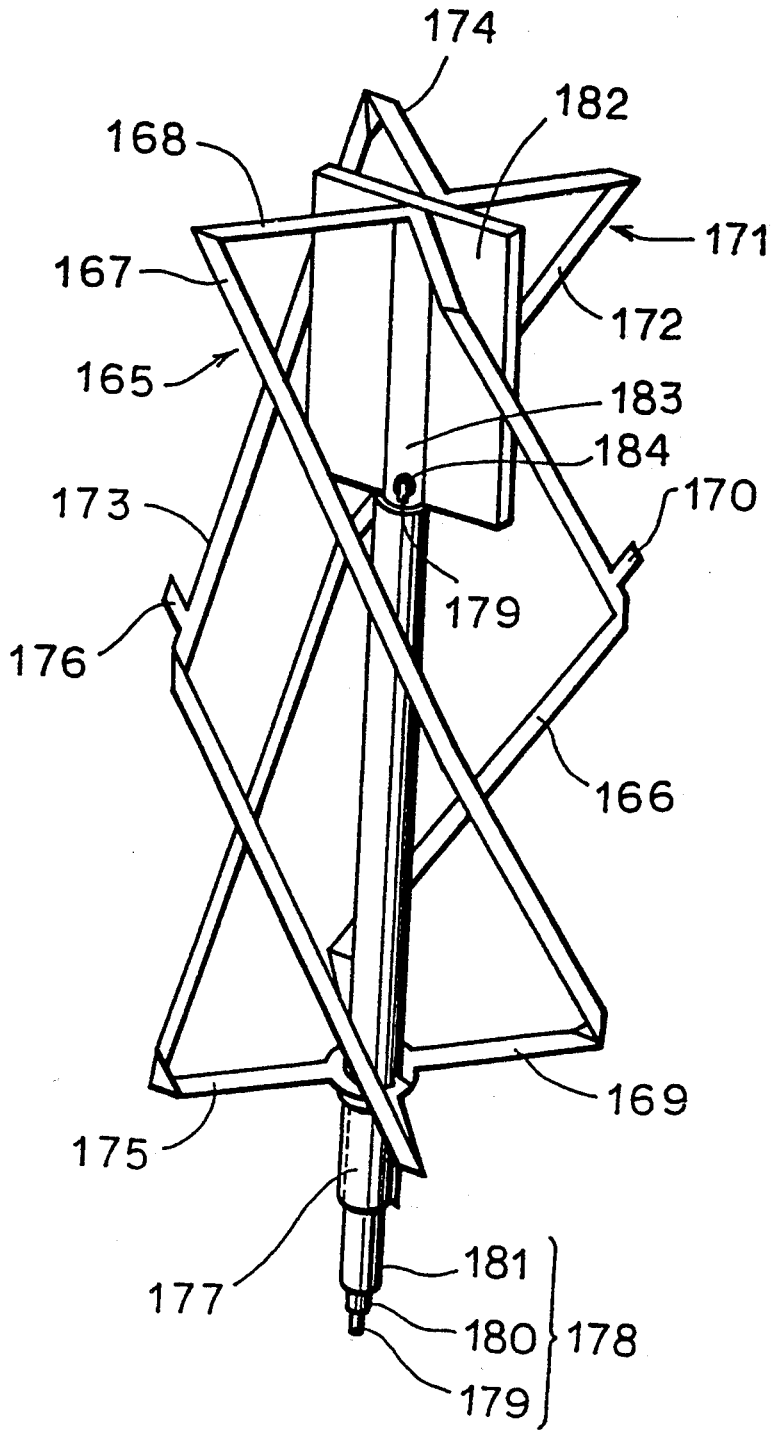
FIG. 10 is a perspective view of a fifth embodiment of a back fire helical antenna according to the present invention.
Figure 11:
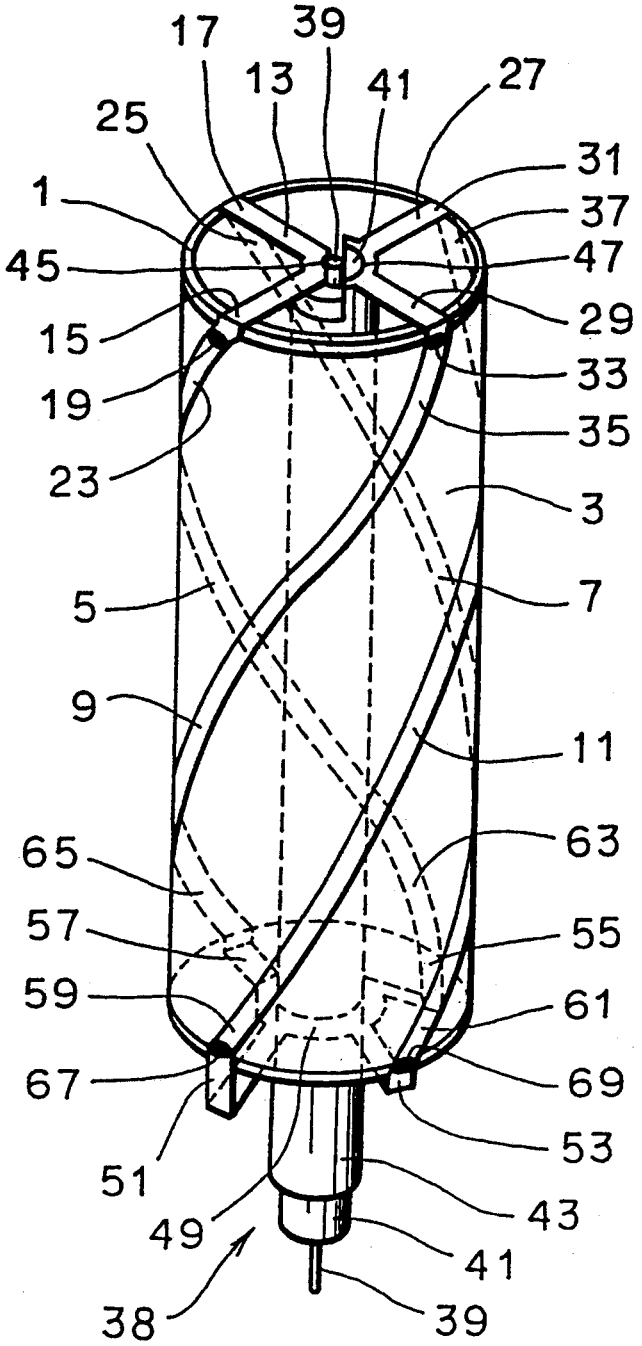
FIG. 11 PRIOR ART
FIG. 11 is a perspective view of a conventional back fire helical antenna.
Figure 12:
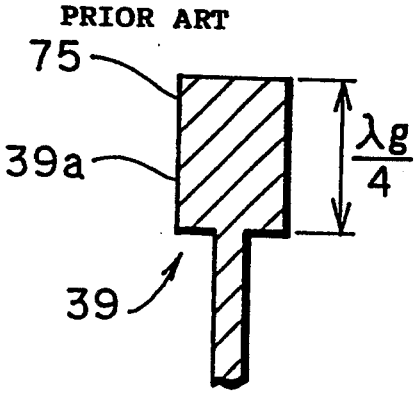
FIG. 12 is a sectional view of a part of a coaxial central conductor of a coaxial cable of the conventional back fire helical antenna.
Figure 13:
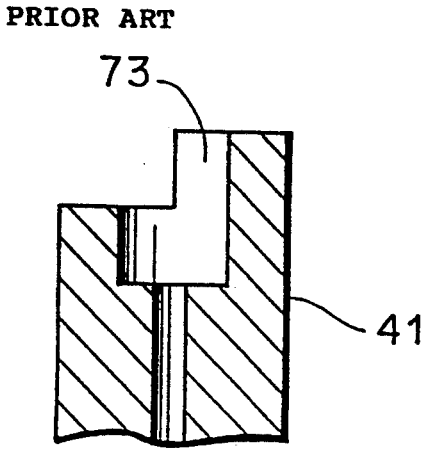
FIG. 13 is a partial sectional view of an insulator of the coaxial cable of the conventional back fire helical antenna.

FIG. 10 is a perspective view of a fifth embodiment of a back fire helical antenna according to the present invention.

A first radiation member 165 has such a structure that radiation conductors 166 and 167, an arm 168 and a lower connection piece 169 are formed integrally by sheet metal working. A stub 170 is integrally formed with and on radiation conductor 166.

A second radiation member 171 has such a structure that radiation conductors 172 and 173, an arm 174 and a lower connection piece 175 are formed integrally by sheet metal working. A stub 176 is formed integrally on radiation conductor 173.

A coaxial cable 178 includes a coaxial central conductor 179, an insulator 180 formed on peripheries of coaxial central conductor 179, and a coaxial outer conductor 181 formed on peripheries of insulator 180. A strip line 183 is formed on a surface of a dielectric substrate 182. Strip line 183 serves as a impedance transformer. Coaxial central conductor 179 is connected by solder 184 to a first end of strip line 183. An earth plate is formed on a back surface of dielectric substrate 182, and coaxial outer conductor 181 is connected by solder (not shown) to the earth plate.

First and second radiation members 165 and 171 are disposed to face each other. Lower connection pieces 169 and 175 are connected to a cylinder 177 attached on the peripheries of coaxial outer conductor 181. Arm 168 is connected by solder (not shown) to a second end of strip line 183. Arm 174 is connected by solder (not shown) to the earth plate formed on the back surface of dielectric substrate 182.

A description will now be made on an operation of the helical antenna shown in FIG. 10. The overall length of a first loop constituted by radiation conductors 167 and 172, arms 168 and 174 and lower connection pieces 169 and 175 is set to be slightly shorter than a wavelength for use. The first loop exhibits capacitive impedance at the wavelength for use. The overall length of a second loop constituted by radiation conductors 166 and 173, arms 168 and 174 and lower connection pieces 169 and 175 is set to be equal to the first loop. Stubs 170 and 176 provided in the second loop serve as open stubs. Adjustment of the length of stub 170 or 176 varies impedance of the second loop, so that the second loop exhibits inductive impedance at the wavelength for use.

With provision of the parallel stubs having appropriate lengths on one of the loops having the same length, a phase difference of 90° is allowed between each of currents flowing through adjacent radiation conductors 166, 167, 172 and 173, and a circularly polarized wave is efficiently received or radiated.

Thus, although it has been difficult to realize a desired loop length in a conventional method in which a suitable difference is set in the overall length of two loops, provision of stubs in parallel according to the present invention facilitates adjustment of stub length by cutting the stubs after assembly of the antenna. This also facilitates realization of a phase difference of 90°.

In this embodiment, an effective position where stubs 170 and 176 are attached is the vicinity of the central part of radiation conductors 166, 173 in which an electric field is maximum. This is because with the electric field becoming increased, a change of phase with respect to a change of stub length becomes relatively decreased, facilitating control of phase. In some case, stubs may be attached to the ends of radiation conductors 166 and 173, arms 168 and 174 or lower connection pieces 169 and 175 for control of phase.

While the first loop length is made equal to the second loop length in the fifth embodiment, a suitable difference may be set between the first and second loop lengths, and these different loops may be combined with parallel stubs, thereby enabling control of phase of a current.

In addition, the number of stubs is not limited to one for each radiation conductor, and a plurality of stubs may be attached. Moreover, it is also possible that parallel stubs are provided respectively on first and second loops and their respective stub lengths are adjusted for control of phase of a current, thereby enabling a change in resonant frequency in which a phase difference in currents between adjacent radiation conductors is 90°. Further, stubs can be used for change of distributions of currents flowing through radiation conductors, thereby changing radiation pattern.

The stubs of the fifth embodiment may be applied to the first through fourth embodiments.

As has been described heretofore, according to the fifth embodiment, since a current phase can be controlled by stubs integrally formed with radiation conductors, a circularly polarized wave can be radiated or received efficiently with a simple structure. It is also possible to easily change a current phase by adjusting the length of stubs after the completion of the antenna.

While a quadrifilar back fire helical antenna has been described in the first through fifth embodiments, the present invention is not limited to this, and a back fire helical antenna of multi-filar type or the like may be applied.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A back fire helical antenna including a radiation conductor disposed helically, comprising:

a strip line including a dielectric substrate having a main surface and a back surface, a first strip conductor formed on said main surface, a second strip conductor formed on said main surface and electrically connected with said first strip conductor, and a conductive earth plate formed on said back surface, said second strip conductor, said dielectric substrate and said conductive earth plate having transformation means for matching impedance of said radiation conductor and impedance of said strip line, said radiation conductor being disposed helically about said strip line set as a center, said radiation conductor having a first end electrically connected with said transformation means, said radiation conductor having a second end electrically connected with said conductive earth plate.

2. The back fire helical antenna according to claim 1, wherein an amplifier circuit for amplifying a current flowing through said strip line is formed on said dielectric substrate.

3. The back fire helical antenna according to claim 1, wherein a width of said first strip conductor is different in size from a width of said second strip conductor.

4. The back fire helical antenna according to claim 1, wherein said first and second strip conductors constitute a strip conductor, and said strip conductor and said conductive earth plate are formed such that respective widths of said strip conductor and said conductive earth plate decrease from the first end to the second end of said dielectric substrate so that said strip line functions as a balun.

5. The back fire helical antenna according to claim 1, wherein said radiation conductor includes first, second, third and fourth radiation conductors, said first and second radiation conductors have respective first ends electrically connected with said second strip conductor, said first and second radiation conductors have respective second ends electrically connected with said conductive earth plate, said third and fourth radiation conductors have respective first ends electrically connected with a portion of said conductive earth plate constituting said transformation means, said third and fourth radiation conductors have their second ends electrically connected with said conductive earth plate, said first and third radiation conductors constitute a first loop set in an inductive impedance state, and said second and fourth radiation conductors constitute a second loop set in a capacitive impedance state.

6. The back fire helical antenna according to claim 5, wherein a stub for controlling a phase of a current flowing through said first loop is formed on said first loop.

7. A back fire helical antenna including a radiation conductor disposed helically, comprising:

a strip line including a dielectric substrate having a main surface and a back surface, a strip conductor formed on said main surface and having a width decreasing from a first end to a second end of said dielectric substrate, and a conductive search plate formed on said back surface and having a width decreasing from the first end to the second end of said dielectric substrate, said strip line having a function of balun with widths of said strip conductor and said conductive earth plate decreasing from the first end to the second end of said dielectric substrate, said radiation conductor disposed helically about said strip line set as a center, said radiation conductor having a first end electrically connected with a portion of said strip line located on the side of the second end of said dielectric substrate, said radiation conductor having a second end electrically connected with said conductive earth plate.

8. A back fire helical antenna including first and second radiation conductors arranged helically about a feeder set as a center, comprising:

a radiation member including said first radiation conductor, said second radiation conductor disposed to be spaced apart from said first radiation conductor, a first end conducting member for electrically connecting a first end of said first radiation conductor and a first end of said second radiation conductor, and a second end connecting member for electrically connecting a second end of said first radiation conductor and a second end of said second radiation conductor, said first and second radiation conductors and said first and second end connecting members being integrally and continuously formed from a single conductor of the same homogeneous material, said radiation member disposed such that said first and second radiation conductors form helicoid with said feeder set as a center, and said first and second end connecting members electrically connect with said feeder.

9. The back fire helical antenna according to claim 8, wherein said radiation member is integrally formed from a planar conductive plate member.

10. The back fire helical antenna according to claim 9, wherein a stub for controlling a phase of a current flowing through said first radiation conductor is formed on said first radiation conductor at the time of blanking of said conductive plate member.

11. The back fire helical antenna according to claim 10, wherein said stub is formed on said first radiation conductor at a portion different from any bent portion of said first radiation conductor.

12. The back fire helical antenna according to claim 8, wherein a stub for controlling a phase of a current flowing through said first radiation conductor is formed on said first radiation conductor.

13. The back fire helical antenna according to claim 12, wherein said stub is formed on said first radiation conductor at a portion different from any bent portion of said first radiation conductor.

14. The back fire helical antenna according to claim 8, wherein said feeder is a coaxial cable having a coaxial central conductor, an insulator formed on peripheries of said coaxial central conductor, and a coaxial outer conductor formed on the periphery of said insulator, said first end connecting member of said first radiation conductor is electrically connected with said coaxial central conductor, while said second end connecting member of said first radiation conductor is electrically connected with said coaxial outer conductor, and said first and second end connecting members of said second radiation conductor are electrically connected with said coaxial outer conductor.

15. A back fire helical antenna including first and second radiation conductors arranged helically about a feeder set as a center, comprising:

a radiation member including said first radiation conductor, said second radiation conductor disposed to be spaced apart from said first radiation conductor, a first end connecting member for electrically connecting a first end of said first radiation conductor and a first end of said second radiation conductor, and a second end connecting member for electrically connecting a second end of said first radiation conductor and a second end of said second radiation conductor, said first and second radiation conductors and said first and second end connecting members being integrally formed of the same material, said radiation member disposed such that said first and second radiation conductors form helicoid with said feeder set as a center, and said first and second end connecting members electrically connected with said feeder, wherein said feeder is a strip line including a dielectric substrate having a main surface and a back surface, a first strip conductor formed on said main surface, a second strip conductor formed on said main surface and electrically connected with said first strip conductor, and a conductive earth plate formed on said back surface, and said second strip conductor, said dielectric substrate and said conductive earth plate constitutes transformation means for matching impedance of said first radiation conductor and impedance of said strip line and matching impedance of said second radiation conductor and impedance of said strip line.

16. A back fire helical antenna including first and second radiation conductors arranged helically about a feeder set as a center, comprising:

a radiation member including said first radiation conductor, said second radiation conductor disposed to be spaced apart from said first radiation conductor, a first end connecting member for electrically connecting a first end of said first radiation conductor and a first end of said second radiation conductor, and a second end connecting member for electrically connecting a second end of said first radiation conductor and a second end of said second radiation conductor, said first and second radiation conductors and said first and second end connecting members being integrally formed of the same material, said radiation member disposed such that said first and second radiation conductors form helicoid with said feeder set as a center, and said first and second end connecting members electrically connected with said feeder, wherein said feeder is a strip line including a dielectric substrate having a main surface and a back surface, a strip conductor formed on said main surface, and a conductive earth plate formed on said back surface, and an amplifier circuit for amplifying a current flowing through said strip line is formed on said dielectric substrate.

17. A back fire helical antenna including first and second radiation conductors arranged helically about a feeder set as a center, comprising:

a radiation member including said first radiation conductor, said second radiation conductor disposed to be spaced apart from said first radiation conductor, a first end connecting member for electrically connecting a first end of said first radiation conductor and a first end of said second radiation conductor, and a second end connecting member for electrically connecting a second end of said first radiation conductor and a second end of said second radiation conductor, said first and second radiation conductors and said first and second end connecting members being integrally formed of the same material, said radiation member disposed such that said first and second radiation conductors form helicoid with said feeder set as a center, and said first and second end connecting members electrically connected with said feeder, wherein said feeder is a strip line including a dielectric substrate having a main surface and a back surface, a strip conductor formed on said main surface, and a conductive earth plate formed on said back surface, and said strip line functions as a balun with widths of said strip conductor and said conductive earth plate decreasing from a first end to a second end of said dielectric substrate.

18. A back fire helical antenna including first and second radiation conductors arranged helically about a feeder set as a center, wherein a first stub for controlling a phase of a current flowing through said first radiation conductor is provided in the vicinity of a central portion in a direction of a length of said first radiation conductor.

19. The back fire helical antenna according to claim 18, further comprising:

third and fourth radiation conductors arranged helically about said feeder set as a center and, said first and second radiation conductors constituting a first loop, a second stub provided on said second radiation conductor, said third and fourth radiation conductors constituting a second loop.

20. The back fire helical antenna according to claim 19, wherein said first loop is set in an inductive impedance state, and said second loop is set in a capacitive impedance state.

21. The back fire helical antenna according to claim 18, wherein said stub is formed on said first radiation conductor at a portion different from any bent portion of said first radiation conductor.

22. A method of manufacturing a back fire helical antenna including first and second radiation conductors arranged helically about a feeder set as a center, said method comprising the steps of:

by blanking a conductive plate member, forming a radiation member including said first radiation conductor, said second radiation conductor spaced from said first radiation conductor, a first end connecting member for electrically connecting a first end of said first radiation conductor and a first end of said second radiation conductor, and a second end connecting member for electrically connecting a second end of said first radiation conductor and a second end of said second radiation conductor, said first and second radiation conductors and said first and second end connecting members being formed integrally;

bending said radiation member into a helical form;

disposing said helical radiation member such that said first and second radiation conductors form helicoid about said feeder set as a center; and electrically connecting said first and second end connecting members to said feeder.

23. The method according to claim 22, wherein a rib for connecting said first and second radiation conductors is formed at the same time said radiation member is formed by blanking, and said rib is cut off after said radiation member provided with said rib is bent in a helical form.

24. The method according to claim 22, wherein a stub for controlling a phase of a current flowing through said first radiation conductor is formed at the same time said radiation member is formed by blanking.

* * * * *